United States Patent [19]

Profera, Jr.

[11] Patent Number: 4,691,205

[45] Date of Patent: Sep. 1, 1987

[54] BEAM FORMING NETWORK FOR CIRCULARLY POLARIZED SHAPED BEAM ANTENNA SYSTEM

[75] Inventor: Charles E. Profera, Jr., Camden, N.J.

[73] Assignee: RCA Corporation, Princeton, N.J.

[21] Appl. No.: 741,873

[22] Filed: Jun. 6, 1985

[51] Int. Cl.[4] ..... H01Q 21/06; H01Q 21/24

[52] U.S. Cl. ..... 342/365; 342/373

[58] Field of Search ..... 343/363, 365, 368, 371, 343/373, 777, 778

[56] References Cited

U.S. PATENT DOCUMENTS

| | | | |
|---|---|---|---|
| 3,205,501 | 9/1965 | Kuhn . | |
| 3,646,559 | 2/1972 | Wiley . | |
| 3,893,124 | 7/1975 | Baker | 343/368 |
| 4,348,680 | 9/1982 | Collier . | |

*Primary Examiner*—Theodore M. Blum

*Attorney, Agent, or Firm*—Clement A. Berard, Jr.; Robert L. Troike

[57] ABSTRACT

A reduced size and weight beam forming network for a circularly polarized N element array antenna system is achieved by interconnecting quadrature couplers without intermediate phase shifters and adding twisted waveguide phase shifters at the coupler outputs to equalize the phase at the array elements.

10 Claims, 8 Drawing Figures

BEAM FORMING NETWORK FOR CIRCULARLY POLARIZED SHAPED BEAM ANTENNA SYSTEM

BACKGROUND OF THE INVENTION

This invention relates generally to a beam forming network for circular polarization, and, more particularly, to a beam forming network for a circularly polarized beam antenna system for communication satellite applications.

A shaped beam antenna system for communication satellite applications typically comprises an offset paraboloid reflector, waveguide horn feed array and beam forming network (BFN) to eastablish the desired feed array illumination characteristics for antenna beam shaping. The BFN is a microwave network for coupling elements that interfaces the individual elements of the feed array with the communication satellite transponder.

The coupling elements utilized in the BFN are usually of the terminated, quadrature type in order to minimize the sensitivity of the antenna system to internally generated reflections, and allow the antenna designer the freedom to select nonuniform distributions for the shaped beam optimization. The desired feed array phase distribution produced by the BFN is typically required to be constant, or, in other words, the phase of the signals from individual elements at the output of the antenna array should be of the same phase. To correct for the quadrature phase differences introduced by the coupling elements fixed phase shifters must be introduced in the network.

A typical BFN with quadrature couplers is shown in FIG. 1 where the required phase compensation is introduced at the coupler level. Note the number of phase shifters between couplers and at the output of the BFN. The use of such phase shifters between the couplers to correct for the phase takes up a great deal of space and adds significantly more weight. Both weight and space are at a premium in satellite applications. It is therefore desirable to find some way in which the overall size and the weight of the BFN can be reduced.

SUMMARY OF THE INVENTION

According to one embodiment of the present invention an improved beam forming network is provided for a circularly polarized shaping antenna system and includes quadrature type couplers coupled to each other in a manner of a tree configuration without phase shifters coupled between the coupling elements. The output phase shifts are adjusted to be equal to each other by means of twisted waveguide sections.

DESCRIPTION OF THE DRAWINGS

FIG. 4 is a sketch of the twisted waveguide phase shifters using rotated step waveguide sections in accordance with one preferred embodiment of the present invention, wherein FIG. 4*a* illustrates a 0° phase shifter;

FIG. 4*b* illustrates a 90° phase shifter;

FIG. 4*c* illustrates a 180° phase shifter;

FIG. 4*d* illustrates a −90° phase shifter; and

DESCRIPTION OF THE PREFERRED EMBODIMENT

Figure 1:
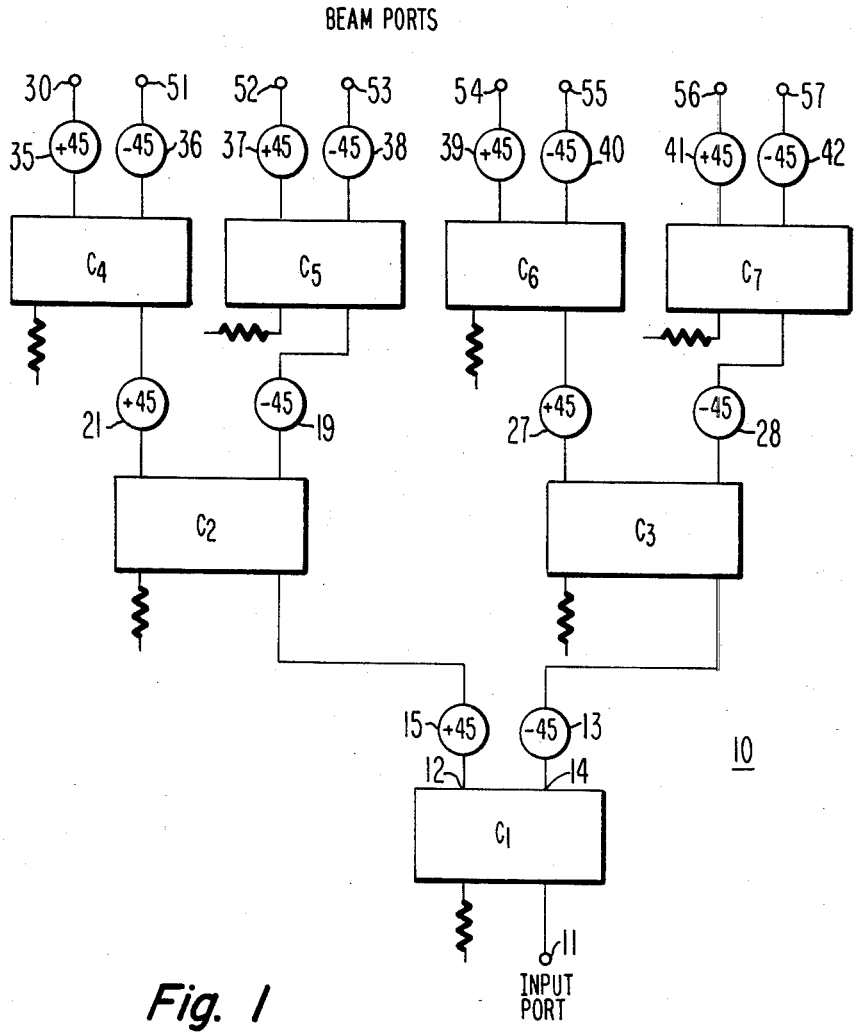
Fig. 1 PRIOR ART
FIG. 1 is a description of a prior art beam forming network.

Referring to FIG. 1 there is illustrated a BFN 10 for coupling to an antenna array according to the prior art. The BFN 10, in this example, is used to split the power from one input port 11 to eight equal phase output ports. The configuration consists of a first quadrature coupler C1, which receives the input power at terminal 11. The quadrature coupler C1 divides the input power with the two outputs at the coupler C1 undergoing a 90° difference in phase shift.

Basically, this difference in phase shift is compensated by the phase shifters 13 and 15 shifting the phase by −45° and +45° respectively. By adding +45° from shifter 15 to the −90° signal from coupler C1 terminal 12 and −45° from phase shifter 13 to the 0° signal from terminal 14, the signal at the output of phase shifter 13 is at −45° and matches the −45° output signal from phase shifter 15.

The outputs from these two phase shifters are separately applied to quadrature couplers C2 and C3. The signals through each of couplers C2 and C3 also undergo a 90° differential phase shift. The phase shifters 19 and 21 which provide the respective phase shifts of −45° and +45° to the output signals of coupler C2 equalize the phase of the signals presented to quadrature couplers C4 and C5. Likewise, phase shifters 27 and 28 add +45° phase and −45° phase respectively to the output signals from coupler C3 to equalize the phase of the signals presented to quadrature couplers C6 and C7.

The quadrature phase output signals of couplers C4, C5, C6 and C7 are each phase shifted −45° at one output and +45° at the other output by the phase shifters 35 through 42 to equalize the phase while dividing the original input power eight ways.

If the couplers C1 thru C7 are 3 db quadrature couplers the original input power is divided equally eight ways. In this manner the power at input port 11 is divided and applied to the output ports 50, 51, 52, 53, 54, 55, 56 and 57 in phase. As mentioned in the background, however, this type of phase compensation requires the placement of these phase shifting elements between each of the couplers which increases the overall weight and the size of the BFN and the overall array structure.

Figure 2:
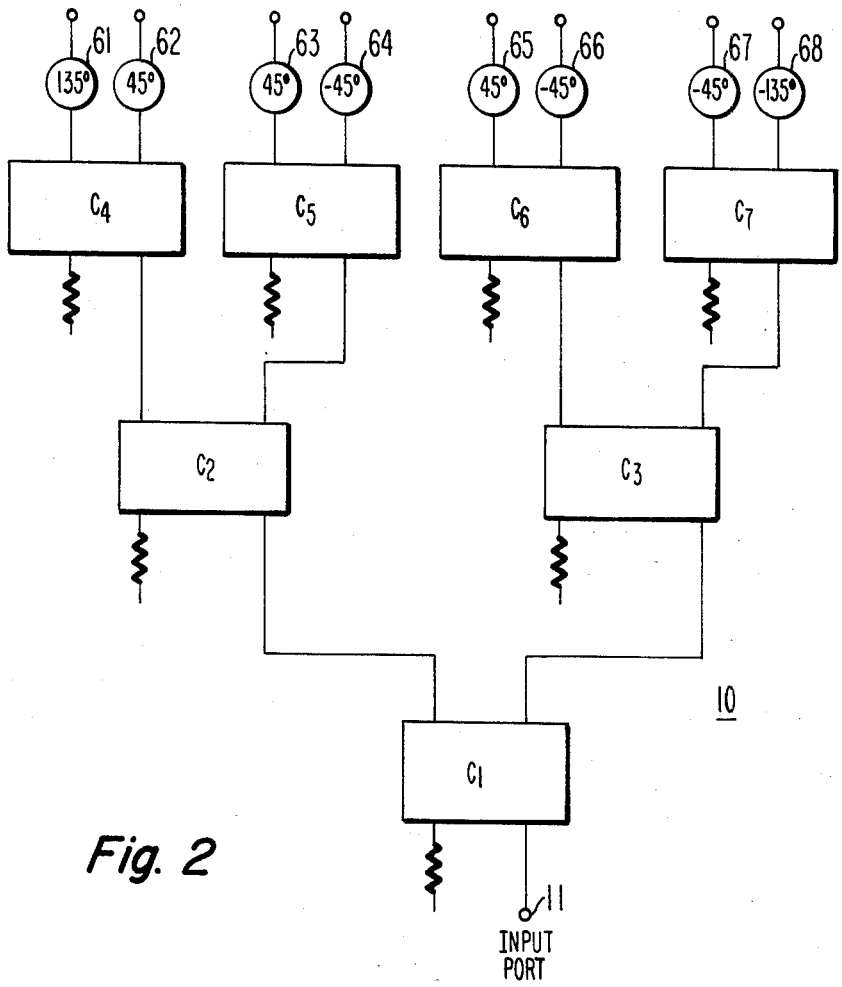
FIG. 2 is a sketch of a beam forming network with the total phase compensation applied at the output of the couplers.

Referring to FIG. 2 there is illustrated the BFN 10 arranged with the total phase compensation applied at the output of the BFN 10 by phase shifters 61 through 68. Note that the output phase shifters 61–68 must provide phase shifts which vary from +135° to −135°. This network must provide this kind of constant phase shift over the entire operating range of the BFN.

The phase of a circularly polarized radiating element can be changed by rotation of the element about its longitudinal axis. The characteristics of a circular polarized microwave signal can be used to advantage in designing the associated BFN according to the teachings herein. As a result, a simplified network design of reduced size and weight can be realized, providing a distinct advantage in a satellite communication system.

Figure 3:
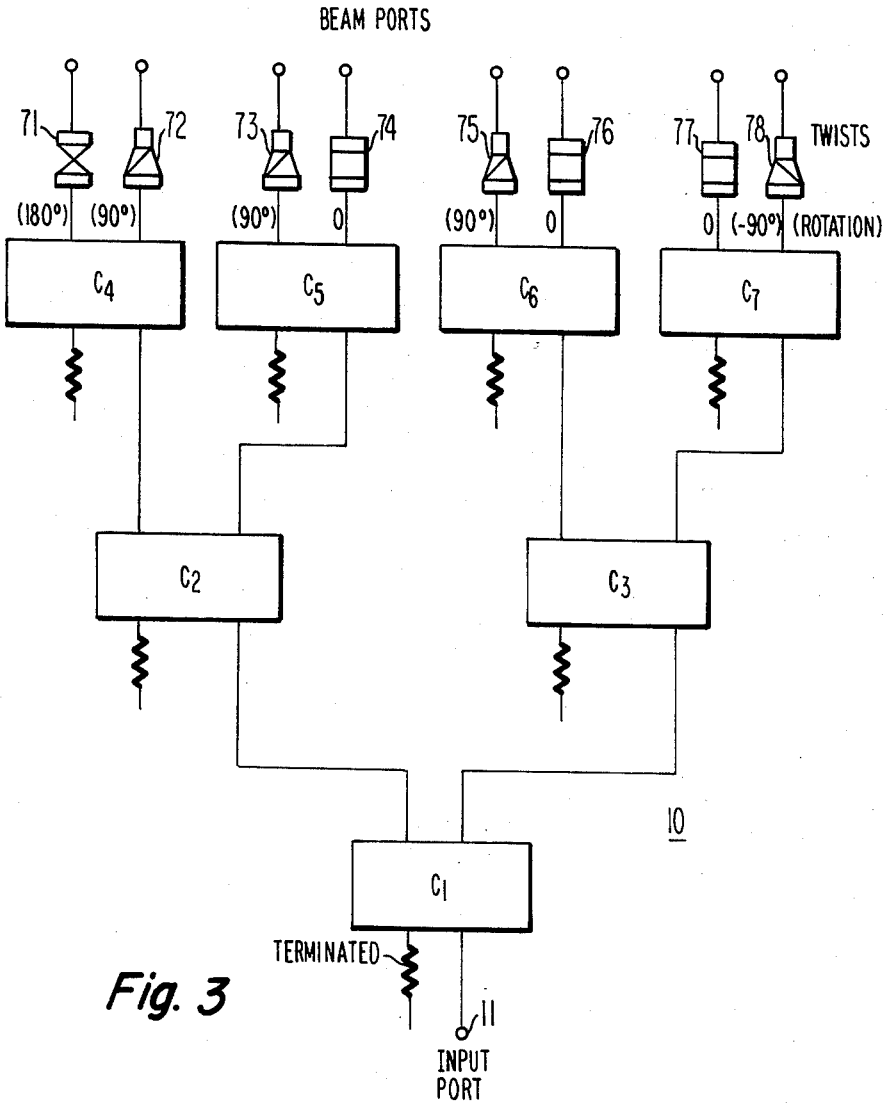
FIG. 3 is a sketch of a beam forming network with fixed twisted waveguide phase shifter in accordance with one embodiment of the present invnetion.

In accordance with the teachings herein and as illustrated in FIG. 3 all of the equalizing phase shifters 71 through 78 are located at the output of the couplers C4 through C7 and are constructed of fixed twisted waveguides where the amount and direction of the twist determines the phase shift. It is noted in FIG. 3 that the quadrature couplers C1 through C7 have no phase shifters interconnected between them. The outputs of the couplers are connected directly to the inputs of the next couplers. The fixed twisted waveguides are coupled to the output of the couplers C4 through C7. In order to minimize the number of types of twisted waveguides a fixed phase shift of 45° has been added to each element to thereby eliminate three different types of twisted waveguides.

Although smooth translational twisted waveguides can provide this phase shift, this would greatly increase the size and length of the overall structure. To reduce the length of the twisted waveguide phase shifters, these phase rotation changes are provided in discrete steps of linear waveguide sections where each section is a quarter wavelength long at about the center operating frequency of the BFN 10. These waveguide sections are coupled in series. The coupling of these waveguide sections to one another causes capacitive loading. In order to maintain the same insertion phase for each waveguide section the number of sections connected for each output arm should be the same.

Referring to FIGS. 4a–4d there is illustrated a top view of four twisted waveguide phase shifters, each with five sections, that provide phase shifts of 0°, 90°, 180° and −90°. Below each phase shifter is a vector diagram illustrating the phase shift in each waveguide section. Each section has a length along its longitudinal center axis of a quarter wavelength at the center operating frequency.

Figure 4:
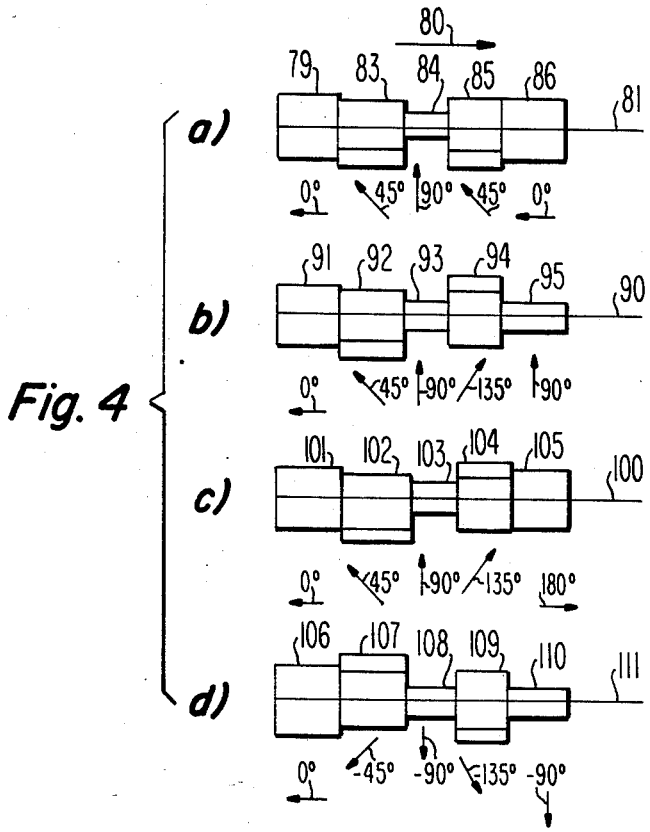

FIG. 4a represents a 0° phase shifter using five linear rectangular waveguide sections each being a quarter wavelength long at the center operating frequency of the system. For the example given, it is assumed that we are operating with right circular polarization and in particular right circular polarization as defined under the IEEE standards. That is, viewing in a direction of arrow 80 in FIG. 4a the electric field vector is rotating clockwise as it recedes away from the input. In order to provide the correct insertion phase of 0°, the second section 83 in FIG. 4a is rotated 45° clockwise about its longitudinal centerline axis 81. The following section 84 is rotated an additional 45° clockwise about its longitudinal centerline axis 81 to produce a total 90° phase rotation relative to the position of the input waveguide section 79. Waveguide section 85 is rotated 45° counterclockwise to reduce the total rotation to 45°. Section 86 is also rotated 45° counterclockwise to get back to 0°. Sections 79 and 86 are in line at 0°. This rotation of sections 83 to 85 provides the appropriate capacitive loading to equalize the insertion phase relative to the other phase shifters.

FIG. 4b illustrates the twisted waveguide of five sections 91–95 for providing a 90° phase shift. In this case section 92 is rotated 45° clockwise and section 93 is rotated clockwise 90° about the longitudinal centerline 90. Section 94 is rotated clockwise another 45° (135° relative to section 91) and section 95 is rotated 45° counterclockwise or back into alignment with section 93.

FIG. 4c illustrates the 180° phase shifter using five sections 101–105. Second section 102 is rotated clockwise 45° about the centerline axis 100 and third section 103 is rotated 90° relative to the input section to bring the propagation axis perpendicular to the original axis at section 101 and thus rotating it clockwise 90°. Section 104 is rotated clockwise 135° relative to input secton 101 (45° relative to section 103). Section 105 is rotated clockwise 180° relative to input section 101 (45° relative to Section 104).

FIG. 4d illustrates a −90° phase shifter using five sections 106–110. The second section 107 is rotated 45° counterclockwise (−45°) about centerline axis 111 from first section 106. The third section 108 is rotated counterclockwise 90° from the first section 106 (−45° from the second section). The fourth section 109 is rotated counterclockwise 135° from the first section 106 (−135°) or −45° from the third section 108. The fifth section 110 is rotated counterclockwise 90° from the first section 106 (clockwise 45° from Section 109) or aligned with section 108 to thereby provide overall −90° phase shift.

Figure 5:
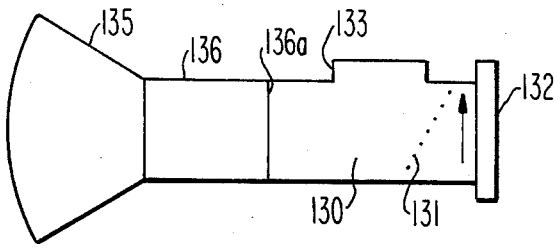
FIG. 5 is a sketch of the orthogonal coupler, polarizer and horn antenna.

The outputs from each of the twisted waveguide phase shifters 71 through 78 in FIG. 3 are coupled to a corresponding orthomode coupler 130, a polarizer 136 and a horn radiator 135 as illustrated, for example in FIG. 5. Orthomode couplers are well known. The orthomode coupler 130 may comprise, for example, parallel wires 131 which extend across the input port 132. The wires 131 extend perpendicular to the orientation of the linear polarization of the signals from the phase shifters 71–78 which is in the orientation of the last waveguide section as earlier described.

The transmitted signals pass through the orthomode coupler onto the polarizer and horn antenna 135. The orthomode coupler 130 includes a resistive load termination at 133 which absorbs the reflected mismatched signal reflected back from the horn antenna 135. The reflected signals are of an orthogonal polarization and are reflected by the wires 131 and are terminated in the load 133. A polarizer 136 is coupled between the orthomode coupler 130 and the horn antenna 135 to excite the circularly polarized signal. The signal from the input at port 11 to port 136a is linearily polarized. The polarizer is one of known type with pins therein to excite the two equal components at quadrature phase.

The disclosed network has the following advantages over conventional networks: (a) rotational phase shift is a constant and is therefore independent of frequency, (b) improved bandwith characteristics which are achieved utilizing the twisted waveguide phase shift approach, (c) wavestep twists can be significantly shorter than counterpart reactive phase shifters producing a network of reduced size and weight offering significant packaging advantages and (d) stepped twists can be designed to track each other in both insertion and reflection versus frequency further improving the BFN frequency response.

This network has been found particularly useful for Direct Broadcast Satellite (DBS) systems and some fixed service international satellite systems.

What is claimed is:

1. A feed network for a circularly polarized shaped beam antenna array having a plurality of antenna elements comprising:

a network of quadrature type couplers coupled to each other in a manner to couple RF signals between a single terminal at one network end and a plurality of terminals at the opposite end such that an RF input signal at said single terminal is power divided according to a desired distribution at said plurality of terminals;

said couplers interconnected without any intervening phase shifters, whereby an input RF signal at said single terminal produces unequal phase shift signals at said plurality of terminals; and means including twisted waveguides coupled to each of said plurality of terminals for equalizing the phase of said signals from said plurality of terminals.

2. The combination of claim 1 wherein each of said twisted waveguides includes linear waveguide sections connected end to end.

3. The combination of claim 2 wherein each twisted waveguide contains at least one linear fixed waveguide section rotated with respect to the input section, and wherein each section is approximately one quarter wavelength long at an operating frequency of the RF signals.

4. The combination of claim 3 wherein each twisted waveguide includes an odd number of fixed linear waveguide sections.

5. The combination of claim 3 wherein said phase shift is achieved by incremental step linear waveguide sections of about 45° rotation.

6. A circularly polarized shaped beam antenna array system comprising:

an input terminal;

N radiator elements arranged to produce a predetermined pattern;

a plurality of polarizers, with a separate polarizer coupled to each of said radiator elements for converting linearly polarized RF signals to circularly polarized RF signals;

a feed network comprising of a plurality of quadrature type couplers coupled between said plurality of polarizers and the input terminal for dividing the power from the input terminal to each of the radiator elements, said quadrature type couplers being coupled together without intermediate phase shifters and thereby introducing phase differences of said RF signals radiated from said radiator elements; and means coupled between the couplers and said polarizers for equalizing the phase of the signals at the horn radiator elements, said phase equalizing means including twisted waveguides physically rotating the polarization of the linearly polarized signal.

7. The combination of claim 6 wherein each of said twisted waveguides includes linear waveguide sections connected end to end.

8. The combination of claim 7 wherein each twisted waveguide contains at least one linear fixed waveguide section rotated with respect to the input section, and wherein each section is approximately one quarter wavelength long at an operating frequency of the RF signals.

9. The combination of claim 8 wherein each twisted waveguide includes an odd number of fixed linear waveguide sections.

10. The combination of claim 8 wherein said phase shift is achieved by incremental step linear waveguide sections of about 45° rotation.

* * * * *